United States Patent [19]

Richard

[11] Patent Number: 4,978,368

[45] Date of Patent: Dec. 18, 1990

[54] DEVICE FOR COOLING HOT PRODUCT GAS EXITING FROM A GASIFICATION REACTOR

[75] Inventor: Hans-Günter Richard, Essen, Fed. Rep. of Germany

[73] Assignee: Krupp koppers GmbH, Essen, Fed. Rep. of Germany

[21] Appl. No.: 392,133

[22] Filed: Aug. 10, 1989

Related U.S. Application Data

[62] Division of Ser. No. 322,077, Mar. 10, 1989, Pat. No. 4,936,873.

[30] Foreign Application Priority Data

Mar. 16, 1988 [DE] Fed. Rep. of Germany ..... 3808729

[51] Int. Cl.[5] ..... C10J 3/89

[52] U.S. Cl. ..... 48/87; 48/128; 48/DIG. 2; 261/117; 261/118; 422/207

[58] Field of Search ..... 48/196 R, 197 R, 202, 48/203, 206, 209, 210, DIG. 2, 62 R, 63, 76, 77, 87, 128; 252/373; 55/83, 84, 89, 93, 94; 261/17, 79.2, 117, 118, DIG. 54; 422/207

[56] References Cited

U.S. PATENT DOCUMENTS

| | | | |
|---|---|---|---|
| 2,767,233 | 10/1956 | Mullen et al. | 48/196 R |
| 3,086,537 | 4/1963 | Sieger | 261/118 |
| 3,262,685 | 7/1961 | Pike et al. | 261/118 |
| 3,456,928 | 7/1965 | Selway | 261/115 |
| 3,495,384 | 2/1970 | Alliger | 261/17 |
| 4,073,832 | 2/1978 | McGann | 261/117 |
| 4,157,244 | 6/1979 | Gernhardt et al. | 48/62 R |
| 4,279,622 | 7/1981 | Jones et al. | 48/197 R |
| 4,469,493 | 9/1984 | Tuovinen et al. | 261/117 |
| 4,731,097 | 3/1988 | Kohnen et al. | 48/76 |

*Primary Examiner*—Peter Kratz

*Attorney, Agent, or Firm*—Michael J. Striker

[57] ABSTRACT

The cooling of a stream of hot product gas exiting from an outlet opening of a gasification reactor is made by way of two separate partial streams of cooling fluid such as a cooling gas, vapor or liquid. The first partial stream of the cooling fluid is fed from the outside substantially in a radial direction against an outer layer of the product gas stream. The second partial stream of cooling liquid is fed axially in a counter direction to the product gas stream to impinge against a central portion thereof. In this manner the path of mixing of the product gas with the cooling fluid is substantially shortened.

1 Claim, 2 Drawing Sheets

DEVICE FOR COOLING HOT PRODUCT GAS EXITING FROM A GASIFICATION REACTOR

This is a division of application Ser. No. 322,077 filed Nov. 10, 1989 now U.S. Pat. No. 4,936,872.

BACKGROUND OF THE INVENTION

The present invention relates to a method of and a device for cooling by means of one or more cooling fluids such as gas, vapor or liquid, a hot product gas exiting from a gasification reactor.

In reactions between the fuel such as for example finely divided coal or other carbonous substances and the means of gasification such as oxygen and possibly steam, there result gasification temperatures between about 1,200° to 1,700° C. Due to the fusion or softening of fuel ashes at high temperatures it is necessary to cool down in a suitable manner the hot product or crude gas exiting from the gasification reactor below the fusion or softening point of ash particles entrained in the crude gas stream in order to prevent the caking and deposition of the ashes in subsequent processing tracks.

The cooling of the hot crude gas also called quenching, can be made by the admixture of cool recycled product gas or of another suitable gas or steam or if need be also of water. The cooling pursues the following two objectives: on the one hand, the inner walls of crude gas channel or duct at the outlet of the gasification reactor should be protected against the hot gas and the bakable ash or cinder particles entrained therein and, on the other hand, the stream of hot gas up to its entry into armored heat exchanger or to a deviation duct should be mixed with the introduced cooling fluid to such an extent that in the entire stream cross-section the temperature is sufficiently low as to preclude the formation of bakable ash or cinder particles. While the attainment of the former objective requires the provision of a streamlined inlet for the cooling medium into the crude gas duct to allow the streaming of the introduced cooling medium as a cool veil spread along the inner wall of the crude gas channel, the fulfillment of the second objective requires the formation of a strong penetration and hence an intensive mixing of both gas streams and/or a relatively long mixing path.

It has been known to introduce the cooling fluid radially inwardly into the crude gas duct. In doing so, the first mentioned objective, namely the protection of the inner walls of the crude gas duct can be achieved through an optimization of the feeding conditions of the cooling fluid. However, to achieve the second objective, namely the homogeneous mixing of the crude gas with the cooling fluids, it is necessary with this kind of mixing to provide a correspondingly long mixing track and hence a correspondingly long crude gas duct.

SUMMARY OF THE INVENTION

It is therefore a general object of the present invention to overcome the aforementioned the disadvantage.

More particularly, it is an object of the present invention to provide an improved method of and device for introducing the cooling fluid into the hot crude gas in such a manner as to obtain a shorter mixing track.

Another object of this invention is to reduce installation and maintenance costs of the gasification plant.

In keeping with these objects and others which will become apparent hereafter, one feature of this invention resides in feeding a partial stream of the cooling fluid substantially radially inwardly into the crude gas stream and at the same time feeding another partial stream of cooling fluid axially counter to the direction of the hot crude gas stream. The substantial radial feeding of the first mentioned partial stream of cooling fluid can be inclined relative to the direction or counterdirection of the stream of crude gas.

The device for carrying out the method of this invention includes a crude gas duct seated on the gas outlet opening of the gasification reactor. A quenching pipe for feeding in the second partial counterstream of cooling fluid is coaxially arranged within the gas duct and opens in the range of the radial feeding of the first partial stream of cooling fluid or slightly downstream thereof. The opening of the quenching pipe corresponds to its cross-section or can be conically extended or converged.

The structural configuration of the coaxial quenching pipe with the crude gas duct must be such that the pipe blows itself free that means it must be prevented that the bakable ash particles come into the mouth of the quenching pipe. Furthermore, the bakable particles must be also prevented from impinging against the inner wall of the crude gas duct in the region where the partial stream of cooling is blown out axially against the crude gas stream. For this purpose according to a further elaboration of this invention the mouth region of the quenching pipe is formed with lateral discharge openings for the cooling fluid. It is also of advantage when at the level of discharge opening the wall of the crude gas duct is also provided with inlet openings for the cooling fluid. While the flow through the lateral discharge opening at the end of the quenching pipe is enforced by the action of dynamic pressure or velocity head, for the feeding of the cooling fluid through the inlet openings in the crude gas duct a static overpressure is necessary. Through the outlet and inlet openings only a relatively small amount of the cooling fluid is introduced namely up to about 20% of the total flow of cooling fluid.

According to another feature of the present invention, the quenching pipe is axially shiftable within the gas duct. In this manner it is possible to vary the cooling effect and when maintenance, repair and cleaning work is needed, then the entire quenching pipe can be moved out in a simple manner.

The quenching pipe can be also constructed as a heat exchanger for example in the form of coiled heat exchanging pipe wall.

For the case of an interference in the feeding of the cooling fluid, an additional emergency feeding means for steam can be provided in the quenching pipe.

The proportion of the partial streams of cooling fluid for the axial central feeding and for the radial peripheral feeding can be varied in broad limits, for example between 1:9 and 9:1, preferably between 1:5 and 5:1.

The clearance between the axial central feeding and the radial peripheral feeding of the cooling liquid relative to the stream of crude gas can be also selected within broad limits, about between 0 and 10 diameters of the crude gas duct.

The ratio of the diameter of the crude gas duct and of the diameter of quenching pipe should be between about 1.2 and 4.

Through the combination of the radial or inclined direction of inward feeding with the axial central feeding of one or more cooling fluids into the crude gas duct it is achieved that the walls of the crude gas duct are reliably protected against caking or baking and moreover the resulting homogenous cooling of the crude gas ensures the protection of the subsequent parts of the gasifying plant.

Furthermore the length of the path of mixing of the cooling fluids with the crude gas is in comparison with prior art methods substantially reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
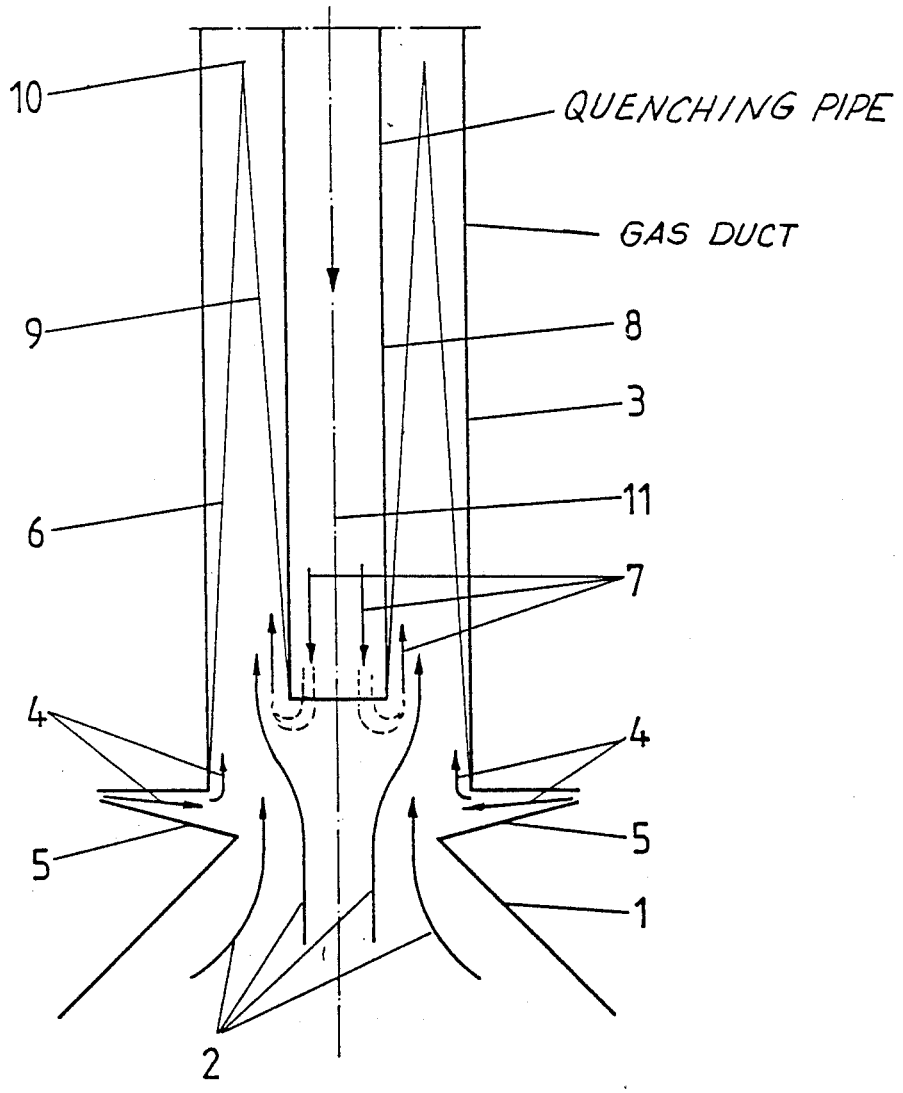
FIG. 1 is a schematic sectional side view of a gasification reactor with a feeding arrangement for cooling fluids according to the invention.

Referring to FIG. 1, a stream of hot crude gas 2 generated in a gasification reactor 1 is discharged outwards into a crude gas channel or duct 3. As mentioned before, the crude gas entrains sticky molten ash or cinder particles predisposed to baking or cake formation. Both the inner wall of the crude gas duct as well as the non-illustrated parts of the gasification plant such as heat exchanger and the like which are connected to the crude gas duct, must be protected against the formation of the bakable particles. For this purpose feeding means for the cooling fluid such as for example, a recirculated cooled product gas, are provided in the crude gas duct. A partial stream of the cooling fluid designated by arrow 4 is fed from the outside through radially directed inlets 5 into the crude gas duct 3 and is mixed with the crude gas 2 along the line 6. Another partial stream of cooling fluid designated by arrow 7 is fed from above counter to the direction of streaming of the crude gas into quenching pipe 8 coaxially arranged in the gas duct 3. In this example, the open end of the quenching pipe is arranged slightly downstream of the radial inlet 5 so that the partial countercurrent 7 after its discharge from the quenching pipe impinges against a central portion of the crude gas stream 2 and is deviated upwards to mix with the crude gas along a line 9.

The lines 6 and 9 in the annular interspace between the quenching pipe and the inner walls of the crude gas duct 3 meet at a level 10 where the intermixing of the crude gas with the cooling fluid is completed over the entire cross-section of the crude gas duct and consequently above this level due to the requisite cooling of the crude gas no bakable ash particles are present. It is evident from the drawing that by virtue of the method of this invention the length of the mixing path, namely from the exit of the crude gas from the gasification reactor 1 up to the level 10, is substantially shorter in comparison with prior art methods using only the radial feeding of the cooling liquid. In the prior art methods the path of mixing extends as far as to the intersection point of the line 6 with the center axis 11 of the crude gas duct 3 and accordingly is considerably longer with concommitant increase of the construction height of the plant.

Figure 2:
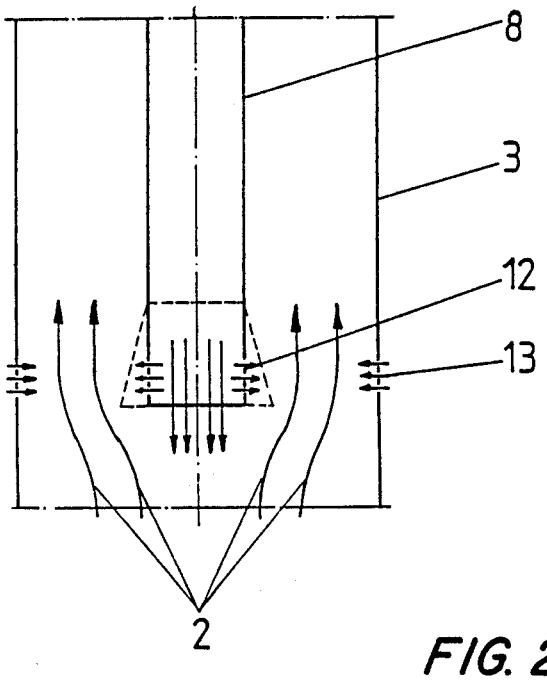
FIGS. 2 and 3 are schematic sectional side views of other embodiments of the feeding arrangement for cooling fluids.

A modification of this invention is illustrated in FIG. 2 where the open end portion of the quenching pipe 8 is provided with lateral or radially directed outlet openings 12 for releasing a portion of the cooling fluid. Dashed lines indicate a possible configuration of the mouth of the quenching pipe 8 which is conically extended. The radial inlets 5 of FIG. 1 are not shown for the sake of clarity. Reference numeral 13 indicates auxiliary inlet openings for the cooling fluid formed in the wall of the crude channel 3 at the level of the outlet openings 12.

Figure 3:
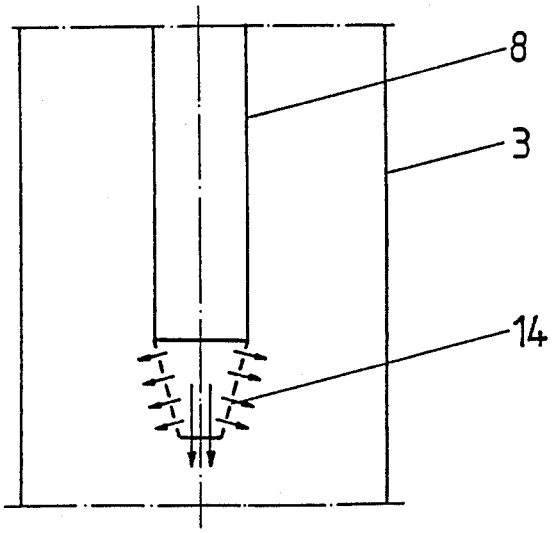

FIG. 3 shows a conically convergent mouth area of the quenching pipe 8 which is also provided with radial or lateral discharge openings 14 for the cooling fluid. Since in this case the convergent mouth is directly attacked by the bakable particles entrained in the crude gas stream, there must be provided an increased number of the discharge openings for the cooling fluid than in the embodiment of FIG. 2 in order to blow out a larger amount of the cooling fluid for protecting the mouth area.

While the invention has been illustrated and described as embodied in specific embodiments of the feeding method and arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed as new and desired to be protected by Letters Patent is set forth in the appended claims:

1. A system comprising a gasification reactor having an outlet opening; a duct extending from said outlet opening for conducting a stream of a hot product gas exiting from the gasification reactor to outside; and means for cooling the stream of a hot gas product in said duct, said cooling means comprising first radial opening formed in said duct adjacent to said outlet opening and defining inlet means for feeding a first partial stream of cooling fluid into an outer portion of said product gas stream; a quenching pipe coaxially arranged within said duct and having a mouth opening in a vicinity of a level of said radial openings to feed axially a second partial stream of cooling fluid against a central portion of said product gas stream, a mouth region of said quenching pipe having lateral discharge openings for radially discharging a part of said second partial stream of cooling fluid, said duct further including second radial opening arranged at a level of said lateral discharge openings of said quenching pipe to feed a portion of said first partial stream of cooling fluid into said duct.

* * * * *